US011164528B2

(12) United States Patent
Xu et al.

(10) Patent No.: US 11,164,528 B2
(45) Date of Patent: Nov. 2, 2021

(54) GATE DRIVING CIRCUIT, TFT ARRAY SUBSTRATE AND DISPLAY DEVICE

(71) Applicant: EverDisplay Optronics (Shanghai) Co., Ltd., Shanghai (CN)

(72) Inventors: Fengqing Xu, Shanghai (CN); Yongliang Qin, Shanghai (CN); Qiujian Tao, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 16/853,760

(22) Filed: Apr. 21, 2020

(65) Prior Publication Data

US 2021/0142732 A1 May 13, 2021

(30) Foreign Application Priority Data

Nov. 13, 2019 (CN) ..... 201911106928.7

(51) Int. Cl.
*G09G 5/10* (2006.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2310/0286* (2013.01)

(58) Field of Classification Search
CPC ..... G09G 3/3266; G09G 3/3233; G09G 2310/0286; G11C 19/28
See application file for complete search history.

(56) References Cited

U.S. PATENT DOCUMENTS

2015/0187323 A1* 7/2015 Jin ..... G09G 3/2092 345/215
2016/0035262 A1* 2/2016 Lee ..... G09G 3/3266 345/690
2019/0005884 A1 1/2019 Yoo

FOREIGN PATENT DOCUMENTS

| | | | |
|---|---|---|---|
| CN | 1262454 | A | 8/2000 |
| CN | 104091574 | A | 10/2014 |
| CN | 104700798 | A | 6/2015 |
| CN | 104966506 | A | 10/2015 |
| CN | 106782258 | A | 5/2017 |
| CN | 107993605 | A | 5/2018 |
| CN | 108231029 | A | 6/2018 |
| CN | 112951140 | A | 6/2021 |

OTHER PUBLICATIONS

The 1st Office Action dated Aug. 30, 2021 for CN patent application No. 201911106928.7.

* cited by examiner

*Primary Examiner* — Adam R. Giesy
(74) *Attorney, Agent, or Firm* — Qinghong Xu

(57) ABSTRACT

A gate driving circuit, a TFT array substrate and a display device are provided by the present disclosure, wherein five switches are provided in the gate driving circuit and a control signal is used to directly or indirectly control the five switches, and further control scanning range of the gate driving circuit.

15 Claims, 2 Drawing Sheets

GATE DRIVING CIRCUIT, TFT ARRAY SUBSTRATE AND DISPLAY DEVICE

CROSS REFERENCE TO RELATED APPLICATIONS

The present application is based upon and claims the priority of Chinese Patent Application No. 201911106928.7, titled "GATE DRIVING CIRCUIT, TFT ARRAY SUBSTRATE AND DISPLAY DEVICE", filed on Nov. 13, 2019. The entire content of this Chinese patent application is incorporated herein by reference.

TECHNICAL FIELD

The present application relates to the field of display technology, and in particular, to a gate driving circuit, a TFT array substrate, and a display device.

BACKGROUND

With the development of semiconductor technology, flat display products have also emerged. Among many flat displays, Active Matrix Organic Lighting Emitting Display (AMOLED) is a display device that uses organic material layers and achieve self-emission by energizing the organic material layer. It has the characteristics such as self-emission, high brightness, high contrast, low operating voltage, and can make flexible display, and is called the most promising display device.

SUMMARY

A gate driving circuit provided by the present disclosure includes: a plurality of cascaded shift register units, a start signal line, and a scanning interval selection unit;

the scanning interval selection unit includes a first switch to a fifth switch, a switch control signal line, a high-level signal line, and a low-level signal line, a source of the first switch and a source of the third switch being connected to the start signal line, a drain of the first switch being connected to an input terminal of a first stage shift register unit, a drain of the third switch being connected to an input terminal of an A-th stage shift register unit, a source of the second switch being connected to an output terminal of an (A−1)th stage shift register unit, a drain of the second switch being connected to the input terminal of the A-th stage shift register unit, a source of the fourth switch being connected to an output terminal of an (A+N)th stage shift register unit, a drain of the fourth switch being connected to an input terminal of an (A+N+1)th stage shift register unit, a source of the fifth switch being connected to the high-level signal line, and a drain of the fifth switch being connected to the low-level signal line;

the gates of the first switch, the second switch, the fourth switch, and the fifth switch are all connected to the switch control signal line, the switch control signal line is configured to transmit a first switch control signal, a second switch control signal that is reverse to the first switch control signal is generated after the first switch control signal passes through the fifth switch, and a gate of the third switch is configured to receive the second switch control signal;

wherein, A is an integer greater than or equal to 2, and N is an integer greater than 1.

Optionally, in the gate driving circuit, the first switch to fifth switch are all PMOS transistors, and the gate of the third switch is connected to the drain of the fifth switch.

Optionally, in the gate driving circuit, the scanning interval selection unit further includes a current limiting resistor, and the current limiting resistor is connected between the drain of the fifth switch and the low-level signal line.

Optionally, in the gate driving circuit, the first switch to fifth switch are all NMOS transistors, and the gate of the third switch is connected to the source of the fifth switch.

Optionally, in the gate driving circuit, the scanning interval selection unit further includes a current limiting resistor, and the current limiting resistor is connected between the high-level signal line and the source of the fifth switch.

Accordingly, the present disclosure also provides a TFT array substrate, which includes the gate driving circuit as described above.

Accordingly, the present disclosure also provides a display device, which includes the TFT array substrate as described above.

BRIEF DESCRIPTION OF THE DRAWINGS

The technical solution of the present disclosure is described in detail below with reference to the drawings and specific embodiments, so that the characteristics and advantages of the present disclosure are more obvious.

DETAILED DESCRIPTION

Figure 1:
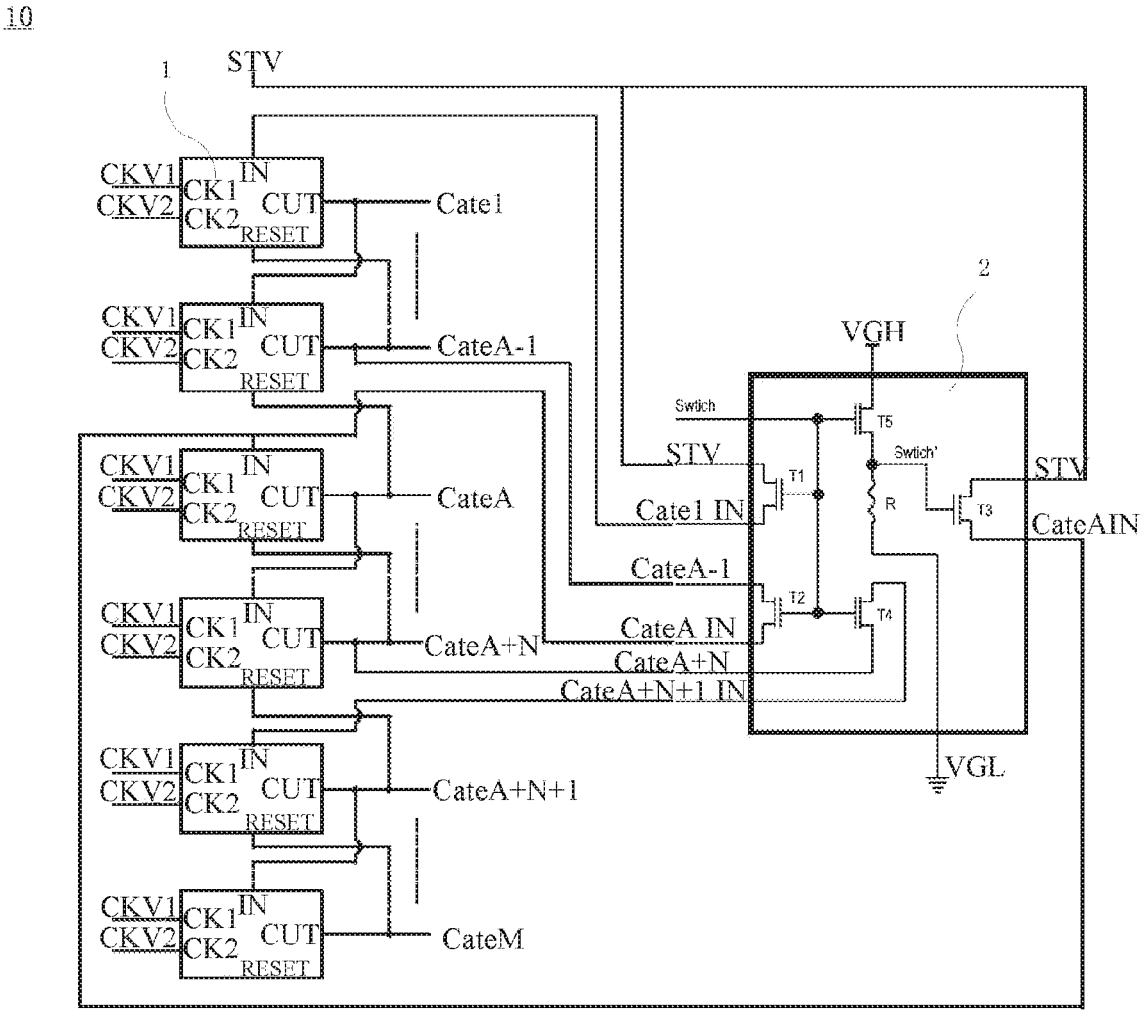
FIG. 1 is a schematic structural diagram of a gate driving circuit according to a first embodiment of the present disclosure.

Example embodiments will now be described more fully with reference to the accompanying drawings. However, the exemplary embodiments can be implemented in various forms and should not be construed as being limited to the embodiments set forth herein. Rather, these embodiments are provided so that this application will be thorough and complete, and will fully convey the concept of example embodiments to those skilled in the art. The same reference numerals in the drawings denote the same or similar structures, and their repeated description will be omitted.

At present, AMOLED has been applied to various smart wearable devices (such as watches). For wearable products, due to the small size of the device, the battery capacity cannot be designed very large. In addition, the smart wearable device has multiple functions, and the idle capability becomes a bottleneck that affects the customer experience.

In order to reduce display power consumption and extend idle time, according an embodiment of the present disclosure, the smart wearable device has two operating states: normal mode and idle mode. In the normal mode, all functions can be enabled, the effective display area of the monitor is displayed normally, and the power consumption is high. After entering the idle mode, idle display is performed only in a small display area within an effective display area, and other functions are disabled to extend the idle time.

In the idle mode, the display area other than the small display area does not display any image, and only displays a black background. However, AMOLED uses a GOA (GateDriveOn Array) circuit to achieve progressive scan driving. Even with partial display, the GOA circuit scans from the first gate line to the last. This has caused unnecessary waste.

Moreover, a fixed data signal must be written into the display area other than the small display area in the effective display area to meet the requirement of the black background, that is, in this case, data signal for the entire effective display area are still required to be input to the AMOLED display. Since the power consumption of the AMOLED display is directly related to the amount of data signals input to the AMOLED display, the power consumption of the AMOLED display will not be proportionally reduced due to the reduction of the actual display area.

Please refer to FIG. 1, which is a schematic structural diagram of a gate driving circuit according to the first embodiment of the present disclosure. As shown in FIG. 1, the gate driving circuit 10 includes a plurality of cascaded shift register units 1, a start signal line, and a scanning interval selection unit 2 which can be implemented by a circuit; the scanning interval selection unit 2 includes a first switch T1 to a fifth switch T5, a switch control signal line, a high-level signal line, and a low-level signal line, a source of the first switch T1 and a source of the third switch T3 being connected to the start signal line, a drain of the first switch T1 being connected to an input terminal of a first stage shift register unit 1, a drain of the third switch T3 being connected to an input terminal of an A-th stage shift register unit 1, a source of the second switch T2 being connected to an output terminal of an (A−1)th stage shift register unit 1, a drain of the second switch T2 being connected to the input terminal of the A-th stage shift register unit 1, a source of the fourth switch T4 being connected to an output terminal of an (A+N)th stage shift register unit 1, a drain of the fourth switch T4 being connected to an input terminal of an (A+N+1)th stage shift register unit 1, a source of the fifth switch T5 being connected to the high-level signal line, and a drain of the fifth switch T5 being connected to the low-level signal line; the gates of the first switch T1, the second switch T2, the fourth switch T4, and the fifth switch T5 are all connected to the switch control signal line, the switch control signal line is configured to transmit a first switch control signal, a second switch control signal that is reverse to the first switch control signal is generated after the first switch control signal passes through the fifth switch T5, and a gate of the third switch T3 is configured to receive the second switch control signal; wherein, A is an integer greater than or equal to 2, and N is an integer greater than 1.

Specifically, the gate driving circuit 10 includes a plurality of shift register units 1, and the plurality of shift register units 1 are sequentially connected to form a cascade structure. Wherein, an input terminal IN of the first stage shift register unit 1 is connected to the start signal line, and the start signal line is configured to transmit a start signal STV. After the gate driving circuit 10 receives the start signal STV, the output terminal of respective stage shift register unit 1 starts to output a scanning pulse signal, and the scanning pulse signal is used to drive a display panel. Respective output of each shift register units 1 of the gate driving circuit 10 corresponds to one gate line of the display panel.

In this embodiment, the gate driving circuit 10 includes M shift register units 1 for generating M scanning pulse signals, that is, generating a first stage scanning pulse signal Gate1, a second stage scanning pulse signal Gate2, . . . , Mth stage scanning pulse signal GateM. Wherein, M is an integer greater than A+N.

As shown in FIG. 1, each shift register unit 1 includes an input terminal IN, a first clock signal terminal CKV1, a second clock signal terminal CKV2, a reset terminal RESET, and an output terminal OUT. Wherein, the first clock signal terminal CKV1 is configured to receive a first clock signal, the second clock signal terminal CKV2 is configured to receive a second clock signal, and the output terminal OUT of a previous stage shift register unit I is connected to the input terminal IN of a next stage shift register unit 1, that is, the scanning pulse signal output from the previous stage shift register unit 1 is provided to the next stage shift register unit 1 as its trigger signal. The each stage shift register unit 1 outputs the scanning pulse signal from its output terminal OUT according to the trigger signal received by the input terminal IN, the first clock signal received by the first clock signal terminal CKV1, and the second clock signal received by the second clock signal terminal CKV2. The reset terminal RESET of the previous stage shift register unit 1 is connected to the output terminal OUT of the next stage shift register unit 1, that is, the scanning pulse signal output from the next stage shift register unit 1 is provided to the previous stage shift register unit 1 as its reset signal.

In this embodiment, the shift register unit having only two clock signal terminals (the first clock signal terminal CKV1 and the second clock signal terminal CKV2) is taken as an example for description. However, the present disclosure is not limited to this, and in other embodiments, the gate driving circuit may further include four clock signal terminals (a first clock signal line CK1 to a fourth clock signal line CK4).

Please continue to refer to FIG. 1. The gate driving circuit 10 further includes a scanning interval selection unit 2. The scanning interval selection unit 2 includes a switch control signal line, a high-level signal line, a low-level signal line, and five MOS transistors (that is, the first switch T1 to the fifth switch T5), the switch control signal line being configured to transmit a first switch control signal Switch, the high-level signal line being configured to transmit a high-level signal VGH, the low-level signal line being configured to transmit a low-level signal VGL, the switch control signal line being connected to the gates of the first switch T1, the second switch T2, the fourth switch T4, and the fifth switch T5, and the switching of the first switch T1, the second switch T2, the fourth switch T4, and the fifth switch T5 being all controlled by the first switch control signal Switch provided by the switch control signal line.

In the scanning interval selection unit 2, the fifth switch T5 and a high-level signal line and a low-level signal line form an reverting circuit, and the reverting circuit outputs an second switch control signal Switch' that is reverse to the first switch control signal Switch according to the first switch control signal Switch. That is, when the first switch control signal Switch is at a low level, the second switch control signal Switch' is at a high level. Conversely, when the first switch control signal Switch is at a high level, the second switch control signal Switch' is at a low level.

Please continue to refer to FIG. 1, a gate of the fifth switch 15 is connected to a first switch control signal line for receiving the first switch control signal Switch, the source of the fifth switch T5 is connected to the high-level signal line for receiving the high-level signal VGH, the drain of the fifth switch T5 is connected to the low-level signal line for receiving the low-level signal VGL, meanwhile, the drain of the fifth switch T5 is connected to another switch control signal line for outputting the second switch control signal Switch'.

As shown in FIG. 1, the reverting circuit further includes a current limiting resistor R, and the current limiting resistor R is connected between the drain of the fifth switch T5 and the low-level signal line.

In this embodiment, the gate driving circuit 10 is based on a PMOS design, and the first switch T1 to fifth switch T5 are all PMOS transistors. The drain of the fifth switch T5 is used as an output terminal of the inverting circuit, and is connected to the gate of the third switch T3.

Please continue to refer to FIG. 1, the gate of the third switch T3 is connected to the output terminal of the inverting circuit, the gate of the third switch T3 being used to receive the second switch control signal Switch', and the switching of the third switch T3 being controlled by the second switch control signal Switch'.

Since the second switch control signal Switch' and the first switch control signal Switch are reverse to each other, when the first switch control signal Switch is at the low level, the first switch T1, the second switch T2, the fourth switch T4, and the fifth switch T5 are all in an on state, in this case, the second switch control signal Switch' is at the high level, and the third switch T3 is in an off state; when the first switch control signal Switch is at the high level, the first switch T1, the second switch T2, the fourth switch T4, and the fifth switch T5 are all in an off state, meanwhile, the second switch control signal Switch' is at the low level, and the third switch T3 is in an on state.

Please continue to refer to FIG. 1, the source of the first switch T1 is configured to receive the start signal STV, the drain of the first switch T1 is connected to the input terminal IN of the first stage shift register unit 1, the source of the third switch 13 is configured to receive the start signal STV, the drain of the third switch T3 is connected to the input terminal IN of the A stage shift register unit 1, the source of the second switch T2 is connected to an output terminal OUT of the (A−1)th stage shift register unit 1, the drain of the second switch T2 is connected to the input terminal IN of the A stage shift register unit 1, the source of the fourth switch 14 is connected to the output terminal OUT of the (A+N)th stage shift register unit 1, and the drain of the fourth switch T4 is connected to the input terminal IN of the (A+N+1)th stage shift register unit 1.

When the first switch T1 is in the on state, the start signal STV is transmitted to the input terminal IN of the first stage shift register unit 1 via the first switch T1, in this case, since the third switch T3 is in the off state, the start signal STV cannot be transmitted to the input terminal IN of the A stage shift register unit 1 via the third switch T3. The scanning interval of the gate driving circuit 10 starts from the first-stage shift register unit 1. Meanwhile, when the second switch T2 and the fourth switch T4 are both in the on state, the trigger signal output from the (A−1)th stage shift register unit 1 is transmitted to the input terminal IN the A-th stage shift register unit 1 via the second switch T2, the trigger signal output from the (A+N)th stage shift register unit 1 is transmitted to the input terminal IN of the (A+N+1)th stage shift register unit 1 via the fourth switch T4. The scanning of the gate driving circuit 10 starts from the first stage and ends at the M-th stage. That is, the gate driving circuit 10 generates M scanning pulse signals, from the first stage scanning pulse signal Gate1, the second stage scanning pulse signal Gate2, . . . to the M-th stage scanning pulse signal GateM.

Conversely, when the first switch T1 is in the off state, the start signal STV cannot be transmitted to the input terminal IN of the first stage shift register unit 1 via the first switch T1, in this case, since the third switch T3 is in the on state, the start signal STV is transmitted to the input terminal IN of the A stage shift register unit 1 via the third switch T3. Meanwhile, when the second switch T2 and the fourth switch T4 are both in the off state, the start signal STV will not turn on GateA−1 via the second switch T2, the trigger signal output from the (A+N)th stage shift register unit 1 cannot be transmitted to the input terminal IN of the (A+N+1)th stage shift register unit 1 via the fourth switch T4. The scanning interval of the gate driving circuit 10 starts from the A-th stage and ends at the (A+N)th stage. That is, the gate driving circuit 10 generates N+1 scanning pulse signals, from the A stage scanning pulse signal GateA, the second stage scanning pulse signal GateA+1, . . . to the (A+N)th stage scanning pulse signal GateA+N.

In this embodiment, by adding five MOS transistors, and using the first switch control signal Switch and the second switch control signal Switch', which are reverse to each other, to control the five MOS transistors, the scanning interval of the gate driving circuit 10 is further controlled. Therefore, the gate driving circuit 10 provided in this embodiment cannot only scan the entire display area but also scan a part of the display area. Wherein, the part of the display area may correspond to an idle display area.

In this embodiment, the scanning interval selection unit 2 includes an inverting circuit, and the inverting circuit is configured to directly generate the second switching control signal Switch' that is reverse to the first switching control signal Switch according to the first switching control signal Switch.

In other embodiments, the scanning interval selection unit 2 may not include the reverting circuit, and the second switch control signal Switch' that is reverse to the first switch control signal Switch may be input by an external signal source. That is, the gate of the third switch T3 is connected to the external signal source that provides the second switch control signal Switch'. In this way, the structure of the scanning interval selection unit 2 is simpler, but the external signal source needs to be added.

In this embodiment, there is only one idle display area (that is, a Gate scanning area), from the A-th stage shift register unit to the (A+N)th stage shift register unit. Wherein, the specific values of A and N are set according to a scan starting position and a scan ending position in the idle display area. The second switch T2 is disposed between the (A−1)th stage shift register unit and the A-th stage shift register unit, the fourth switch T4 is disposed between the (A+N)th stage shift register unit and the (A+N+1)th stage shift register units, the first switch T1 is disposed at a position corresponding to the first stage shift register unit, and the third switch T3 is disposed at a position corresponding to the A-th stage shift register unit.

In other embodiments, the idle display area (that is, the Gate scanning area) may be two, three or even more. Correspondingly, in the gate driving circuit 10, more switches can be disposed, that is, corresponding switches are disposed at the scanning starting position and the scanning ending position of each Gate scanning area, respectively, to realize the scanning of the plurality of idle display areas.

Accordingly, the present disclosure also provides a gate driving method. Please continue to refer to FIG. 1, the gate driving method includes: in the normal mode, turning on the first switch, the second switch, the fourth switch and the fifth switch, turning off the third switch, and sequentially outputting the scanning pulse signals by the each state shift register unit; in the idle mode, turning off the first switch, the second switch, the fourth switch, and the fifth switch, and turning on the third switch and sequentially outputting the scanning pulse signals by only the A-th stage shift register unit to the (A+N)th shift register unit.

Specifically, in the normal mode, the first switch control signal Switch is at the low level, so that the first switch T1, the second switch T2, the fourth switch T4, and the fifth switch T5 are all in the on state (turning on), while the second switch control signal Switch' is at the high level, so that the third switch T3 is in the off state (turning off). In this case, the start signal STY is transmitted to the input terminal IN of the first stage shift register unit 1 via the first switch, the first stage shift register unit 1 outputs the first stage scanning pulse signal Gate1, the second stage shift register unit 1 outputs the second stage scanning pulse signal Gate2, and so on, the each stage shift register units 1 sequentially operates. In one frame period, the gate driving circuit 10 sequentially outputs M scanning pulse signals GateM, that is, the first stage scanning pulse signal Gate1, the second stage scanning pulse signal Gate2 to the Mth stage scanning pulse signal GateM, and the M scanning pulse signals are sequentially supplied to the display panel.

In the idle mode, the first switch control signal Switch is at the high level, so that the first switch T1, the second switch T2, the fourth switch T4, and the fifth switch T5 are all in the off state (turning off), while the second switch control signal Switch' is at the low level, so that the third switch T3 is in the on state (turning on). In this case, the start signal STV cannot be transmitted to the input terminal IN of the first stage shift register unit 1 via the first switch T1, but is transmitted to the input terminal IN of the A-th stage shift register unit 1 via the third switch T3. The A-th stage shift register unit 1 outputs the A-th stage scanning pulse signal GateA, and the (A+1)th stage shift register unit 1 outputs the (A+1)th stage scanning pulse signal GateA+1, and so on, the respective stage shift register units 1 sequentially operates, and the (A+N)th stage shift register unit 1 outputs the (A+N)th stage scanning pulse signal GateA+N. Since the fourth switch 14 is in the off state, the trigger signal output from the (A+N)th stage shift register unit 1 cannot be transmitted to the input terminal IN of the (A+N+1)th stage shift register unit 1. Therefore, in one frame period, the gate driving circuit 10 sequentially outputs N+1 scanning pulse signals GateM, that is, the A-th stage scanning pulse signal GateA, the (A+1)th stage scanning pulse signal GateA+1 to the (A+N)th stage scanning pulse signal GateA+N, and the N+1 scanning pulse signals are sequentially supplied to the display panel.

In the idle mode, since only the A-th stage shift register unit to the A+N stage shift register unit sequentially output the scanning pulse signal, other shift register units do not need to operate, which reduces the power consumption of the Gate scanning. Meanwhile, data signals (data) beyond the idle display area can also be omitted, so the power consumption in the standby state can be greatly reduced, and the idle time of the entire machine can be effectively extended.

Accordingly, the present disclosure also provides a TFT array substrate. The TFT array substrate includes a plurality of gate lines and the gate driving circuit 10 as described above. The output terminal of each of the shift register units I in the gate driving circuit 10 is connected to a gate line. The gate driving circuit 10 scans a plurality of gate lines by the plurality of shift register units 1.

Accordingly, the present disclosure also provides a display device. The display device includes the TFT array substrate as described above. The display device may be a liquid crystal display device, or an organic light emitting display device or other types of display devices.

Compared with the conventional display devices, the display device provided in this embodiment has a longer idle time because the gate driving circuit 10 described above is adopted, so that the display product has stronger competitiveness.

Figure 2:
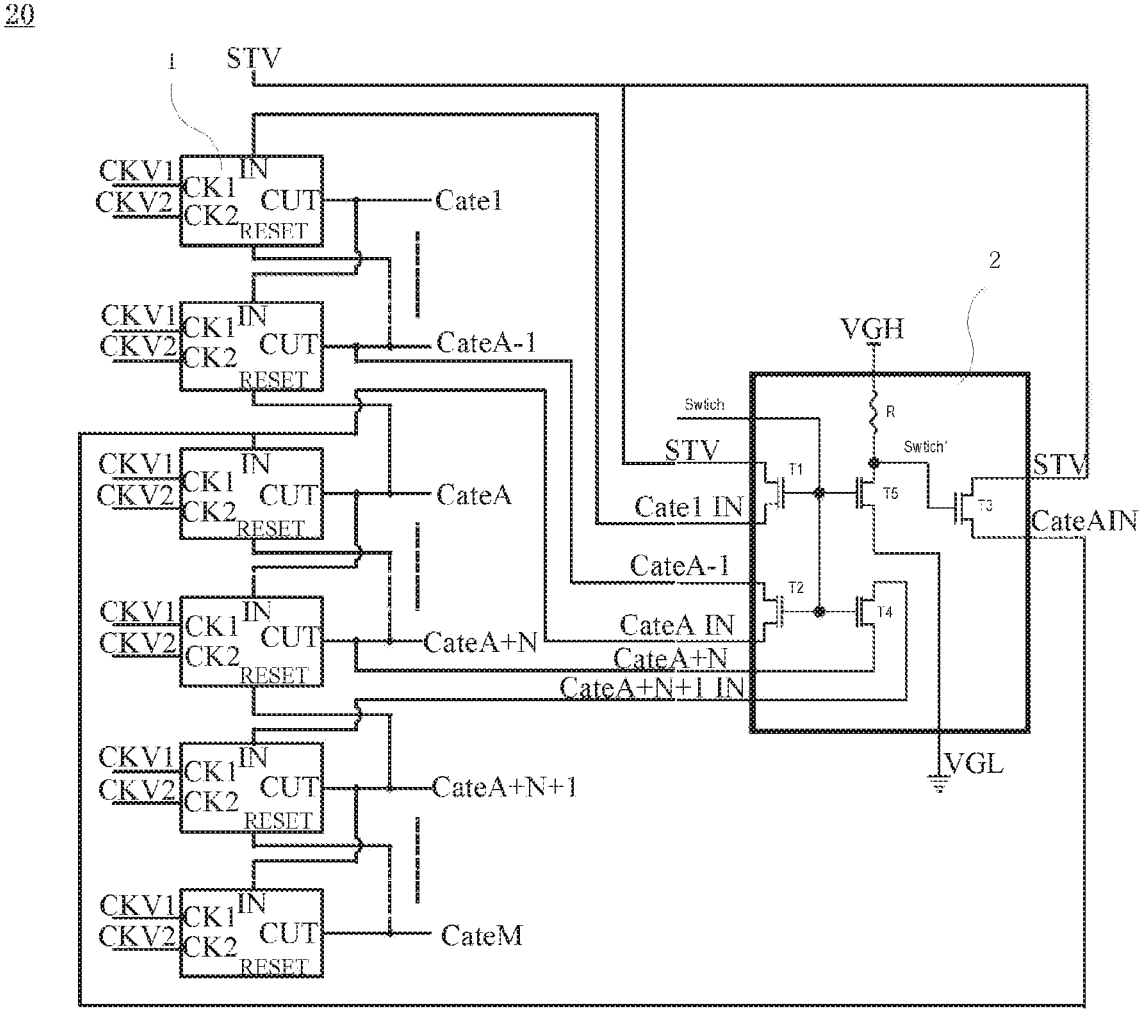
FIG. 2 is a schematic structural diagram of a gate driving circuit according to a second embodiment of the present disclosure.

Please refer to FIG. 2, which is a schematic structural diagram of a gate driving circuit according to a second embodiment of the present disclosure. As shown in FIG. 2, the gate driving circuit 20 includes a plurality of cascaded shift register units 1, a start signal line, and a scanning interval selection unit 2; the scanning interval selection unit 2 includes a first switch T1 to a fifth switch T5, a switch control signal line, a high-level signal line, and a low-level signal line, wherein, a source of the first switch T1 and a source of the third switch T3 are both connected to the start signal line, a drain of the first switch T1 is connected to an input terminal of a first stage shift register unit 1, a drain of the third switch T3 is connected to an input terminal of an A-th stage shift register unit 1, a source of the second switch T2 is connected to an output terminal of an (A−1)th stage shift register unit 1, a drain of the third switch T2 is connected to the input terminal of the A-th stage shift register unit 1, a source of the fourth switch T4 is connected to an output terminal of an (A+N)th stage shift register unit 1, an drain of the fourth switch T4 is connected to an input terminal of an (A+N+1)th stage shift register unit 1, a source of the fifth switch T5 is connected to the high-level signal line, and a drain of the fifth switch T5 is connected to the low-level signal line; the gates of the first switch T1, the second switch T2, the fourth switch T4, and the fifth switch T5 are all connected to the switch control signal line, the switch control signal line is configured to transmit a first switch control signal, a second switch control signal that is reverse to the first switch control signal is generated after the first switch control signal passes through the fifth switch T5, and a gate of the third switch T3 is configured to receive the second switch control signal; wherein, A is an integer greater than or equal to 2, and N is an integer greater than 1.

Specifically, the gate driving circuit 20 is based on a NMOS design, and the first switch T1 to fifth switch T5 are all NMOS transistors, Wherein, the fifth switch T5, the high-level signal line and the low-level signal line form an inverting circuit, and a source of the fifth switch T5 is used as an output terminal of the inverting circuit and is connected to the gate of the third switch T3.

Please continue to refer to FIG. 2, the reverting circuit includes the fifth switch T5, the high-level signal line, and the low-level signal line, wherein, a gate of the fifth switch T5 is connected to a first switch control signal line for receiving a first switch control signal Switch, the source of the fifth switch T5 is connected to the high-level signal line for receiving a high-level signal VGH, the drain of the fifth switch T5 is connected to the low-level signal line for receiving a low-level signal VGL, and the source of the fifth switch T5 is connected to another switch control signal line for outputting a second switch control signal Switch'.

As shown in FIG. 2, the reverting circuit 2 further includes a current limiting resistor R, and the current limiting resistor R is connected between the high-level signal line and the source of the fifth switch T5.

When the first switch control signal Switch is at a high level, the fifth switch T5 is turned on and the second switch control signal Switch' is at a low level; when the first switch control signal Switch is at a low level, the fifth switch T5 is turned off, and the switch control signal Switch' is at a high level.

Since the second switch control signal Switch' and the first switch control signal Switch are reverse to each other, when the first switch control signal Switch is at the low level, the first switch T1, the second switch T2, the fourth switch T4 and the fifth switch T5 are all in an off state, in this case, the second switch control signal Switch' is at the high level, and the third switch T3 is in an on state; when the first switch control signal Switch is at the high level, the first switch T1, the second switch T2, the fourth switch T4, and the fifth switch T5 are all in an on state, in this case, the second switch control signal Switch' is at the low level, and the third switch T3 is in an off state.

This embodiment is different from the first embodiment in that the gate driving circuit is based on the NMOS design instead of the PMOS design, and the type of the five MOS transistors is NMOS instead of PMOS. Correspondingly, the current limiting resistor R in the reverting circuit is not connected between a low-level signal terminal and the drain of the fifth switch T5, but is connected between a high-level signal terminal and the source of the fifth switch T5. Meanwhile, the output terminal of the inverting circuit is the source rather than the drain of the fifth switch T5.

In summary, in the gate driving circuit, the TFT array substrate and the display device provided by the present disclosure, by providing five switches in the gate driving circuit and using a control signal, which directly or indirectly controls the five switches, and further controls the scanning range of the gate driving circuit, it may avoid the waste caused by the scanning of non-display area, effectively reduce the overall power consumption of display device, greatly extend the idle time of whole machine, and improve the experience of terminal customer.

The above content is a further detailed description of the present application in combination with specific preferred embodiments, and it cannot be considered that the specific implementation of the present application is limited to these descriptions. For those of ordinary skill in the technical art to which this application belongs, without deviating from the concept of this application, several simple deductions or replacements can be made, which should all be regarded as falling within the protection scope of this application.

What is claimed is:

1. A gate driving circuit, comprising: a plurality of cascaded shift register units, a start signal line, and a scanning interval selection circuit;

wherein the scanning interval selection circuit comprises a first switch, a second switch, a third switch, a fourth switch, and a fifth switch, a switch control signal line, a high-level signal line, and a low-level signal line, a source of the first switch and a source of the third switch being connected to the start signal line, a drain of the first switch being connected to an input terminal of a first stage shift register unit, a drain of the third switch being connected to an input terminal of an A-th stage shift register unit, a source of the second switch being connected to an output terminal of an (A−1)th stage shift register unit, a drain of the second switch being connected to the input terminal of the A-th stage shift register unit, a source of the fourth switch being connected to an output terminal of a (A+N)th stage shift register unit, a drain of the fourth switch being connected to an input terminal of an (A+N+1)th stage shift register unit, a source of the fifth switch being connected to the high-level signal line, and a drain of the fifth switch being connected to the low-level signal line;

gates of the first switch, the second switch, the fourth switch, and the fifth switch are all connected to the switch control signal line, the switch control signal line is configured to transmit a first switch control signal, a second switch control signal that is reverse to the first switch control signal is generated after the first switch control signal passes through the fifth switch, and a gate of the third switch is configured to receive the second switch control signal;

wherein, A is an integer greater than or equal to 2, and N is an integer greater than 1.

2. The gate driving circuit according to claim 1, wherein, the first switch, the second switch, the third switch, the fourth switch, and the fifth switch are all PMOS transistors, and the gate of the third switch is connected to the drain of the fifth switch.

3. The gate driving circuit according to claim 2, wherein, the scanning interval selection circuit further comprises a current limiting resistor, and the current limiting resistor is connected between the drain of the fifth switch and the low-level signal line.

4. The gate driving circuit according to claim 1, wherein, the first switch, the second switch, the third switch, the fourth switch, and the fifth switch are all NMOS transistors, and the gate of the third switch is connected to the source of the fifth switch.

5. The gate driving circuit according to claim 4, wherein, the scanning interval selection circuit further comprises a current limiting resistor, and the current limiting resistor is connected between the high-level signal line and the source of the fifth switch.

6. A TFT array substrate, comprising a gate driving circuit, wherein the gate driving circuit comprises:

a plurality of cascaded shift register units, a start signal line, and a scanning interval selection circuit;

wherein the scanning interval selection circuit comprises a first switch, a second switch, a third switch, a fourth switch, and a fifth switch, a switch control signal line, a high-level signal line, and a low-level signal line, a source of the first switch and a source of the third switch being connected to the start signal line, a drain of the first switch being connected to an input terminal of a first stage shift register unit, a drain of the third switch being connected to an input terminal of an A-th stage shift register unit, a source of the second switch being connected to an output terminal of an (A−1)th stage shift register unit, a drain of the second switch being connected to the input terminal of the A-th stage shift register unit, a source of the fourth switch being connected to an output terminal of a (A+N)th stage shift register unit, a drain of the fourth switch being connected to an input terminal of an (A+N+1)th stage shift register unit, a source of the fifth switch being connected to the high-level signal line, and a drain of the fifth switch being connected to the low-level signal line;

gates of the first switch, the second switch, the fourth switch, and the fifth switch are all connected to the switch control signal line, the switch control signal line is configured to transmit a first switch control signal, a second switch control signal that is reverse to the first switch control signal is generated after the first switch control signal passes through the fifth switch, and a gate of the third switch is configured to receive the second switch control signal;

wherein, A is an integer greater than or equal to 2, and N is an integer greater than 1.

7. The TFT array substrate according to claim 6, wherein, the first switch, the second switch, the third switch, the fourth switch, and the fifth switch are all PMOS transistors, and the gate of the third switch is connected to the drain of the fifth switch.

8. The TFT array substrate according to claim 7, wherein, the scanning interval selection circuit further comprises a current limiting resistor, and the current limiting resistor is connected between the drain of the fifth switch and the low-level signal line.

9. The TFT array substrate according to claim 6, wherein, the first switch, the second switch, the third switch, the fourth switch, and the fifth switch are all NMOS transistors, and the gate of the third switch is connected to the source of the fifth switch.

10. The TFT array substrate according to claim 9, wherein, the scanning interval selection circuit further comprises a current limiting resistor, and the current limiting resistor is connected between the high-level signal line and the source of the fifth switch.

11. A display device, comprising a TFT array substrate having a gate driving circuit, wherein the gate driving circuit comprises:

a plurality of cascaded shift register units, a start signal line, and a scanning interval selection circuit;

wherein the scanning interval selection circuit comprises a first switch, a second switch, a third switch, a fourth switch, and a fifth switch, a switch control signal line, a high-level signal line, and a low-level signal line, a source of the first switch and a source of the third switch being connected to the start signal line, a drain of the first switch being connected to an input terminal of a first stage shift register unit, a drain of the third switch being connected to an input terminal of an A-th stage shift register unit, a source of the second switch being connected to an output terminal of an (A−1)th stage shift register unit, a drain of the second switch being connected to the input terminal of the A-th stage shift register unit, a source of the fourth switch being connected to an output terminal of a (A+N)th stage shift register unit, a drain of the fourth switch being connected to an input terminal of an (A+N+1)th stage shift register unit, a source of the fifth switch being connected to the high-level signal line, and a drain of the fifth switch being connected to the low-level signal line;

gates of the first switch, the second switch, the fourth switch, and the fifth switch are all connected to the switch control signal line, the switch control signal line is configured to transmit a first switch control signal, a second switch control signal that is reverse to the first switch control signal is generated after the first switch control signal passes through the fifth switch, and a gate of the third switch is configured to receive the second switch control signal;

wherein, A is an integer greater than or equal to 2, and N is an integer greater than 1.

12. The display device according to claim 11, wherein, the first switch, the second switch, the third switch, the fourth switch, and the fifth switch are all PMOS transistors, and the gate of the third switch is connected to the drain of the fifth switch.

13. The display device according to claim 12, wherein, the scanning interval selection circuit further comprises a current limiting resistor, and the current limiting resistor is connected between the drain of the fifth switch and the low-level signal line.

14. The display device according to claim 11, wherein, the first switch, the second switch, the third switch, the fourth switch, and the fifth switch are all NMOS transistors, and the gate of the third switch is connected to the source of the fifth switch.

15. The display device according to claim 14, wherein, the scanning interval selection circuit further comprises a current limiting resistor, and the current limiting resistor is connected between the high-level signal line and the source of the fifth switch.

* * * * *